US007621477B2

(12) United States Patent
Young

(10) Patent No.: US 7,621,477 B2
(45) Date of Patent: Nov. 24, 2009

(54) HAMMERMILL HAMMER

(75) Inventor: Roger T. Young, Davenport, IA (US)

(73) Assignee: Genesis III, Inc., Prophetstown, IL (US)

( * ) Notice: Subject to any disclaimer, the term of this patent is extended or adjusted under 35 U.S.C. 154(b) by 0 days.

(21) Appl. No.: 11/897,586

(22) Filed: Aug. 31, 2007

(65) Prior Publication Data

US 2008/0011890 A1 Jan. 17, 2008

Related U.S. Application Data

(63) Continuation-in-part of application No. 11/544,526, filed on Oct. 6, 2006, now Pat. No. 7,559,497, which is a continuation-in-part of application No. 11/150,430, filed on Jun. 11, 2005, now Pat. No. 7,140,569.

(51) Int. Cl.
*B02C 13/28* (2006.01)

(52) U.S. Cl. ..... 241/194; 241/197

(58) Field of Classification Search ..... 241/194, 241/195, 197, 300, 189.1
See application file for complete search history.

(56) References Cited

U.S. PATENT DOCUMENTS

| | | | | |
|---|---|---|---|---|
| 1,266,894 | A | 5/1918 | Williams | |
| 1,693,058 | A | 11/1928 | Shelton | |
| 1,759,905 | A | 5/1930 | Keith | |
| 1,854,844 | A * | 4/1932 | Kaemmerling | 241/32 |
| 1,911,718 | A | 5/1933 | Saunders | |
| 2,607,538 | A | 8/1952 | Larson | |
| 2,763,439 | A | 9/1956 | Mankoff | |
| 3,278,126 | A | 10/1966 | Ratkowski | |
| 3,482,789 | A | 12/1969 | Newell | |
| 3,627,212 | A | 12/1971 | Stanton | |
| 3,738,586 | A * | 6/1973 | Fabert, Jr. | 241/195 |
| 4,129,262 | A | 12/1978 | Lowry | |
| 4,141,512 | A | 2/1979 | Francis | |
| 4,142,687 | A | 3/1979 | Potwin | |
| 4,177,956 | A | 12/1979 | Fawcett | |
| 4,558,826 | A | 12/1985 | Martinek | |
| 4,729,516 | A | 3/1988 | Williams, Jr. | |
| 4,907,750 | A | 3/1990 | Seifert | |
| 5,377,919 | A | 1/1995 | Rogers et al. | |
| 5,381,975 | A | 1/1995 | Chon | |
| 5,465,912 | A | 11/1995 | Graybill | |
| 5,605,291 | A | 2/1997 | Doskocil | |
| 5,611,496 | A | 3/1997 | Fleenor | |

(Continued)

*Primary Examiner*—Mark Rosenbaum
(74) *Attorney, Agent, or Firm*—Hamilton IP Law, PC; Jay R. Hamilton; Charles A. Damschen

(57) ABSTRACT

An improved free swinging hammer mill hammer design is disclosed and described for comminution of materials such as grain and refuse. The hammer design of the present art is adaptable to most hammer mill or grinders having free swinging systems. The improved hammermill hammer may incorporate multiple comminution edges for increased comminution efficiencies. The design as disclosed and claimed may be forged to increase the strength of the hammer. A rod hole shoulder surrounding a portion of the rod hole adjacent the neck may be reduced in the radial dimension. The shape of the hammer body may be varied, as disclosed and claimed, to further improve hammer strength, or reduce or maintain the weight of the hammer while increasing the amount of force delivered to the material to be comminuted.

16 Claims, 16 Drawing Sheets

U.S. PATENT DOCUMENTS

| | | | | |
|---|---|---|---|---|
| 5,842,653 | A | 12/1998 | Elliott et al. | |
| 5,904,306 | A | 5/1999 | Elliott et al. | |
| 6,131,838 | A | 10/2000 | Balvanz | |
| 6,260,778 | B1 | 7/2001 | Wenger | |
| 6,419,173 | B2 | 7/2002 | Balvanz et al. | |
| 6,481,654 | B1 | 11/2002 | Balvanz | |
| 6,517,020 | B1 | 2/2003 | Smith | |
| 6,622,951 | B1 | 9/2003 | Recker | |
| 6,971,598 | B2 * | 12/2005 | Schillinger et al. | 241/194 |
| 7,140,569 | B2 | 11/2006 | Young | |

* cited by examiner

HAMMERMILL HAMMER

CROSS REFERENCE TO RELATED APPLICATIONS

This patent application is a continuation-in-part of U.S. patent application Ser. No. 11,544,526 previously filed on Oct. 6, 2006 now U.S. Pat. No. 7,559,497 which was a continuation-in-part of patent application Ser. No. 11,150,430, previously filed on Jun. 11, 2005, now U.S. Pat. No. 7,140, 569. Applicant herein claims priority from and incorporates herein by reference in its entirety the preceding referenced applications.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND OF THE INVENTION

A number of different industries rely on impact grinders or hammermills to reduce materials to a smaller size. For example, hammermills are often used to process forestry and agricultural products as well as to process minerals, and for recycling materials. Specific examples of materials processed by hammermills include grains, animal food, pet food, food ingredients, mulch and even bark. This invention although not limited to grains, has been specifically developed for use in the grain industry. Whole grain corn essentially must be cracked before it can be processed further. Dependent upon the process, whole corn may be cracked after tempering yet before conditioning. A common way to carry out particle size reduction is to use a hammermill where successive rows of rotating hammer like devices spinning on a common rotor next to one another comminute the grain product. For example, methods for size reduction as applied to grain and animal products are described in Watson, S. A. & P. E. Ramstad, ed. (1987, Corn: Chemistry and Technology, Chapter 11, American Association of Cereal Chemist, Inc., St. Paul, Minn.), the disclosure of which is hereby incorporated by reference in its entirety. The application of the invention as disclosed and herein claimed, however, is not limited to grain products or animal products.

Hammermills are generally constructed around a rotating shaft that has a plurality of disks provided thereon. A plurality of free-swinging hammers are typically attached to the periphery of each disk using hammer rods extending the length of the rotor. With this structure, a portion of the kinetic energy stored in the rotating disks is transferred to the product to be comminuted through the rotating hammers. The hammers strike the product, driving into a sized screen, in order to reduce the material. Once the comminuted product is reduced to the desired size, the material passes out of the housing of the hammermill for subsequent use and further processing. A hammer mill will break up grain, pallets, paper products, construction materials, and small tree branches. Because the swinging hammers do not use a sharp edge to cut the waste material, the hammer mill is more suited for processing products which may contain metal or stone contamination wherein the product the may be commonly referred to as "dirty". A hammer mill has the advantage that the rotatable hammers will recoil backwardly if the hammer cannot break the material on impact. One significant problem with hammer mills is the wear of the hammers over a relatively short period of operation in reducing "dirty" products which include materials such as nails, dirt, sand, metal, and the like. As found in the prior art, even though a hammermill is designed to better handle the entry of a "dirty" object, the possibility exists for catastrophic failure of a hammer causing severe damage to the hammermill and requiring immediate maintenance and repairs.

Hammermills may also be generally referred to as crushers—which typically include a steel housing or chamber containing a plurality of hammers mounted on a rotor and a suitable drive train for rotating the rotor. As the rotor turns, the correspondingly rotating hammers come into engagement with the material to be comminuted or reduced in size. Hammermills typically use screens formed into and circumscribing a portion of the interior surface of the housing. The size of the particulate material is controlled by the size of the screen apertures against which the rotating hammers force the material. Exemplary embodiments of hammermills are disclosed in U.S. Pat. Nos. 5,904,306; 5,842,653; 5,377,919; and 3,627, 212.

The four metrics of strength, capacity, run time and the amount of force delivered are typically considered by users of hammermill hammers to evaluate any hammer to be installed in a hammermill. A hammer to be installed is first evaluated on its strength. Typically, hammermill machines employing hammers of this type are operated twenty-four hours a day, seven days a week. This punishing environment requires strong and resilient material that will not prematurely or unexpectedly deteriorate. Next, the hammer is evaluated for capacity, or more specifically, how the weight of the hammer affects the capacity of the hammermill. The heavier the hammer, the fewer hammers that may be used in the hammermill by the available horsepower. A lighter hammer then increases the number of hammers that may be mounted within the hammermill for the same available horsepower. The more force that can be delivered by the hammer to the material to be comminuted against the screen increases effective comminution (i.e. cracking or breaking down of the material) and thus the efficiency of the entire comminution process is increased. In the prior art, the amount of force delivered is evaluated with respect to the weight of the hammer.

Finally, the length of run time for the hammer is also considered. The longer the hammer lasts, the longer the machine run time, the larger profits presented by continuous processing of the material in the hammermill through reduced maintenance costs and lower necessary capital inputs. The four metrics are interrelated and typically tradeoffs are necessary to improve performance. For example, to increase the amount of force delivered, the weight of the hammer could be increased. However, because the weight of the hammer increased, the capacity of the unit typically will be decreased because of horsepower limitations. There is a need to improve upon the design of hammermill hammers available in the prior art for optimization of the four (4) metrics listed above.

BRIEF SUMMARY OF THE INVENTION

The improvement disclosed and described herein centers on an improved hammer to be used in a hammermill. The improved metallic free swinging hammer is for use in rotatable hammer mill assemblies for comminution. The improved hammer is compromised of a first end for securement of the hammer within the hammer mill. The second end of the hammer is opposite the first end and is for contacting material for comminution. This second end typically requires treatment to improve the hardness of the hammer blade or tip.

Treatment methods such as adding weld material to the end of the hammer blade are well known in the art to improve the comminution properties of the hammer. These methods typically infuse the hammer edge, through welding, with a metallic material resistant to abrasion or wear such as tungsten carbide. See for example U.S. Pat. No. 6,419,173, incorporated herein by reference, describing methods of attaining hardened hammer tips or edges as are well known in the prior art by those practiced in the arts.

The methods and apparatus disclosed herein may be applied to a single hammer or multiple hammers to be installed in a hammermill. The hammer may be produced through forging, casting or rolling as found in the prior art. Applicant has previously taught that forging the hammer improves the characteristic of hardness for the hammer body. Applicant has also taught the thickness of the hammer edge, in relation to the hammer neck, may also be increased. Redistributing material (and thus weight) from the hammer neck back to the hammer edge, to increase the moment produced by the hammer upon rotation while allowing the overall weight of the hammer to remain relatively constant. Applicant's present design may be combined with previous teachings related to the shape of the hammer and the methods of producing the hammer. Thus, the present design may enjoy an increase in actual hammer momentum available for comminution developed and delivered through rotation of the hammer than the hammers as found in the prior art. This increased momentum reduces recoil, as previously disclosed and claimed, thereby increasing operational efficiency. However, because the hammer design is still free swinging, the hammers can still recoil, if necessary, to protect the hammermill from destruction or degradation if a non-destructible foreign object has entered the mill. Thus, effective horsepower requirements are held constant, for similar production levels, while actual strength, force delivery and the area of the screen covered by the hammer face within the hammermill, per each revolution of the hammermill rotor, are improved. The overall capacity of a hammermill employing the various hammers embodied herein is increased over existing hammers.

As taught, increasing the hammer strength and edge weld hardness creates increases stress on the body of the hammer and the hammer rod hole. In the prior art, the roundness of the rod hole deteriorates leading to elongation of the hammer rod hole. Elongation eventually translates into the entire hammer mill becoming out of balance or the individual hammer breaking at the weakened hammer rod hole area which can cause a catastrophic failure or a loss of performance. When a catastrophic failure occurs, the hammer or rod breaking can result in metallic material entering the committed product requiring disposal. This result can be very expensive to large processors of metal sensitive products i.e. grain processors. Additionally, catastrophic failure of the hammer rod hole can cause the entire hammermill assembly to shift out of balance producing a failure of the main bearings and or severe damage to the hammermill itself.

Either result can require the hammermill process equipment to be shutdown for maintenance and repairs, thus reducing overall operational efficiency and throughput. During shutdown, the hammers typically must be replaced due to edge wear or rod-hole elongation.

Another embodiment of this invention illustrates an improved hammermill hammer having an increased number of individual grinding surfaces or edges to improve comminution contact surface area. The hammer design as shown has four (4) individual edges that are offset in vertical height but are nearly equivalent in radial distance from the center point of the rod hole. During use, two (2) of the four (4) contacting edges are used. The hammer shown typically replaces a hammer having only two (2) contacting edges of which only one (1) is used at a time. The width of each contacting edge as shown is equivalent to the width of the hammer. As shown, the edges of the hammer have been welded to increase hardness. The notched portions of the hammer end allow for pocketing and feed of the grain to the contacting edges. It is believed the hammer as shown will increase hammer contact efficiency and therefore overall hammermill efficiency. Although the present art is not so limited, when the present art is produced using forging techniques versus casting or rolling from bar stock the strength of the rod hole is improved and there is a noticeable decrease in the susceptibility of the rod hole to elongation. Furthermore, this embodiment of the present art may be practiced with a hammer body having of uniform shape.

It is therefore an object of the present invention to disclose and claim a hammer design that is stronger and lighter because it of its thicker and wider securement end but lighter because of its thinner and narrower neck section.

It another object of the present art to improve the securement end of free swinging hammers for use in hammer mills while still using methods and apparatus found in the prior art for attachment within the hammermill assembly.

It is another object of the present invention to improve the operational runtime of hammermill hammers.

It is another object of the present invention to disclose hammers having hardened edges by such means as welding or heat treating.

It is another object of the present invention to disclose and claim a hammer allowing for improved projection of momentum to the hammer blade tip to thereby increase the delivery of force to comminution materials.

It is another object of the present invention to disclose and claim a hammer design that is stronger and lighter because it is forged.

It is another object of the present invention to disclose and claim an embodiment of the present hammer design that weighs no more than three pounds.

It is another object of the present invention to disclose and claim a hammer design that allows for improved efficiency by increasing the number of hammer contact edges.

It is another object of the present invention to disclose and claim a hammer design that allows for improved efficiency by increasing the hammer contact surface area.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION

Listing of Elements

Figure 1:
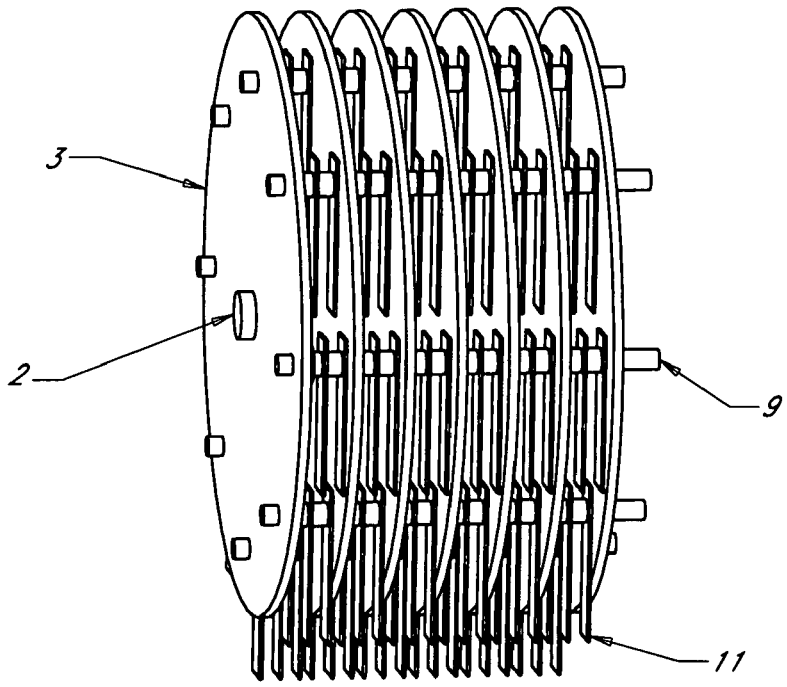
FIG. 1 (PRIOR ART)
FIG. 1 provides a perspective view of the internal configuration of a hammer mill at rest as commonly found in the prior art.

| Element | Element # |
|---|---|
| Hammermill assembly | 1 |
| Hammermill drive shaft | 2 |
| End plate | 3 |
| End plate drive shaft hole | 4 |
| End plate hammer rod hole | 5 |
| Center plate | 6 |
| Center plate drive shaft hole | 7 |
| Center plate hammer rod hole | 8 |
| Hammer rods | 9 |
| Spacer | 10 |
| Hammer (swing or free-swinging) | 11 |
| Hammer body | 12 |
| Hammer tip | 13 |
| Hammer rod hole | 14 |
| Hammer center line | 15 |
| Center of rod hole | 16 |
| First end of hammer (securement end) | 17 |
| Thickness of first end of hammer | 18 |
| Radial distance to first and fourth contact points | 19 |
| Hammer neck | 20 |
| Radial distance to second and third contact points | 21 |
| Hammer neck hole | 22 |
| Second end of hammer (contact end) | 23 |
| Thickness of 2nd end of hammer | 24 |
| Hammer hardened contact edge | 25 |
| Linear distance from center line to first and fourth contact points | 26 |
| Single stage hammer rod hole shoulder | 27 |
| Second stage hammer rod hole shoulder | 28 |
| Hammer swing length (linear distance from center line to second and third contact points) | 29 |
| Hammer Neck edges (hourglass) | 30 |
| Hammer Neck edges (parallel) | 31 |
| $1^{st}$ contact surface | 32 |
| $2^{nd}$ contact surface | 33 |
| $3^{rd}$ contact surface | 34 |
| Secondary contact surface | 35 |
| $1^{st}$ contact point | 36 |
| $2^{nd}$ contact point | 37 |
| $3^{rd}$ contact point | 38 |
| $4^{th}$ contact point | 39 |
| Edge pocket | 40 |

DETAILED DESCRIPTION

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Figure 2:
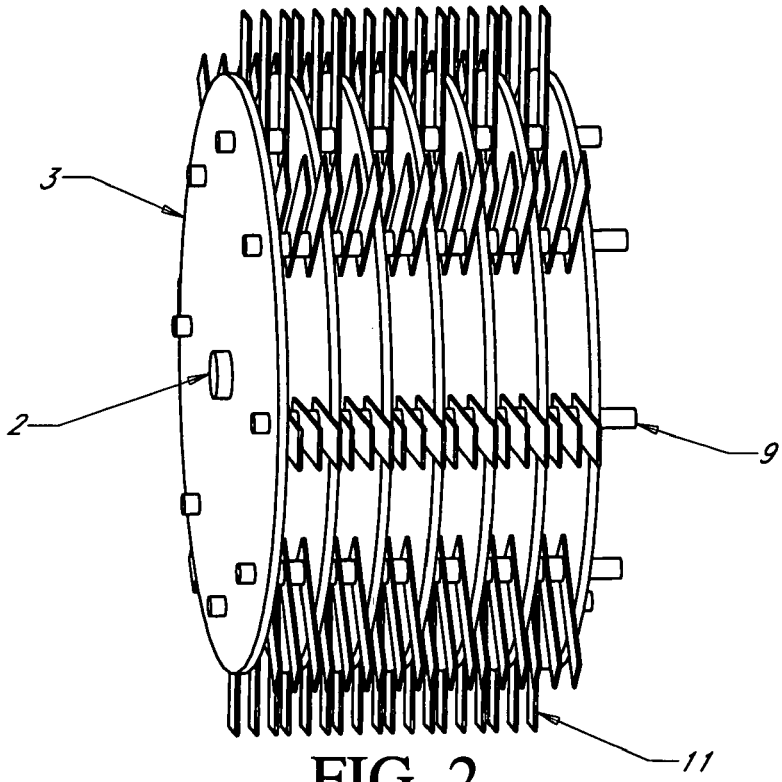
FIG. 2 (PRIOR ART)
FIG. 2 provides a perspective view of the internal configuration of a hammermill during operation as commonly found in the prior art.

As shown in FIGS. 1-2, the hammermills found in the prior art use what are known as free swinging hammers 11 or simply hammers 11, which are hammers 11 that are pivotally mounted to the rotor assembly and are oriented outwardly from the center of the rotor assembly by centrifugal force. FIG. 1 shows a hammermill assembly as found in the prior art at rest. The hammers 11 are attached to hammer rods 9 inserted into and through center plates 6. Swing hammers 11 are often used instead of rigidly connected hammers in case tramp metal, foreign objects, or other non-crushable matter enters the housing with the particulate material to be reduced, such as grain.

If rigidly attached hammers contact such a non-crushable foreign object within the hammermill assembly housing, the consequences of the resulting contact can be severe. By comparison, swing hammers 11 provide a "forgiveness" factor because they will "lie back" or recoil when striking non-crushable foreign objects.

FIG. 2 shows the hammermill assembly 1 as in operation. For effective reduction in hammermills using swing hammers 11, the rotor speed must produce sufficient centrifugal force to hold the hammers in the fully extended position while also having sufficient hold out force to effectively reduce the material being processed. Depending on the type of material being processed, the minimum hammer tips speeds of the hammers are usually 5,000 to 11,000 feet per minute ("FPM"). In comparison, the maximum speeds depend on shaft and bearing design, but usually do not exceed 30,000 FPM. In special high-speed applications, the hammermills can be designed to operate up to 60,000 FPM.

Figure 3:
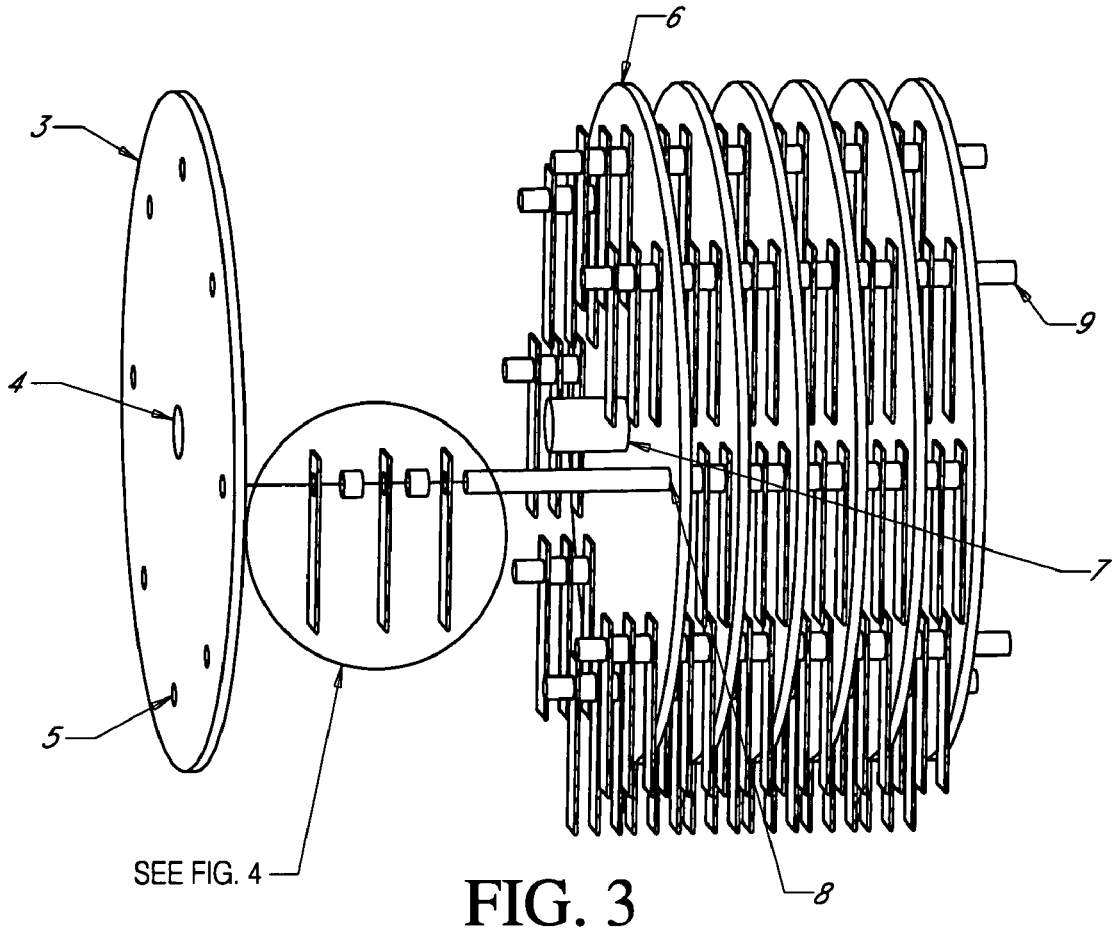
FIG. 3 (PRIOR ART)
FIG. 3 provides an exploded perspective view of a hammermill as found in the prior art as shown in FIG. 1.
Figure 4:
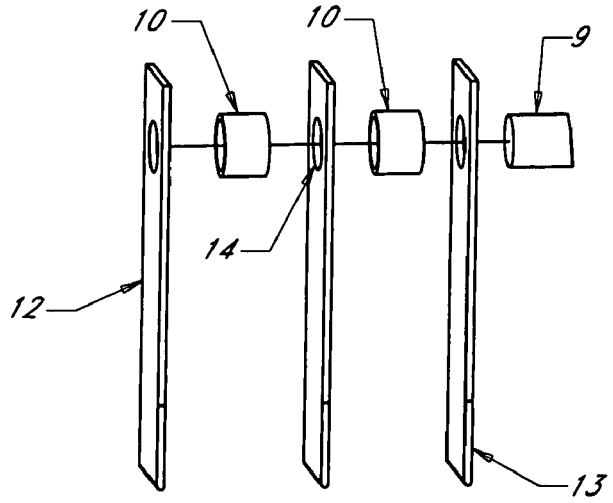
FIG. 4 (PRIOR ART)
FIG. 4 provides an enlarged perspective view of the attachment methods and apparatus as found in the prior art and illustrated in FIG. 3.

FIG. 3 illustrates the parts necessary for attachment and securement within the hammermill hammer assembly 1 as shown. Attachment of a plurality of hammers 11 secured in rows substantially parallel to the hammermill drive shaft 2 is illustrated in FIGS. 3 and 4. The hammers 11 secure to hammer rods 9 inserted through a plurality of center plates 6 and end plates 3 wherein the plates (3, 6) orient about the hammermill drive shaft 2. The center plates 6 also contain a number of distally located center plate hammer rod holes 8. Hammer pins, or rods 9, align through the holes 3, 6 in the end and center plates 3, 6 and in the hammers 11. Additionally, spacers 10 align between the plates. As is well known to those of skill in the arts, a lock collar (not shown) would be placed on the end of the hammer rod 9 to compress and hold the spacers 10 and the hammers 11 in alignment. All these parts require careful and precise alignment relative to each other.

In the case of disassembly for the purposes of repair and replacement of worn or damaged parts, the wear and tear causes considerable difficulty in realigning and reassembling of the rotor parts. Moreover, the parts of the hammermill hammer assembly 1 are usually keyed to each other, or at least to the drive shaft 2, this further complicates the assembly and disassembly process. For example, the replacement of a single hammer 11 can require disassembly of the entire hammer assembly 1. Given the frequency at which wear parts require replacement, replacement and repairs constitute an extremely difficult and time consuming task that considerably reduces the operating time of the size reducing machine. As shown in FIGS. 3 and 4 for the prior art, removing a single damaged hammer 11 may take in excess of five (5) hours, due to both the rotor design and to the realignment difficulties related to the problems caused by impact of debris with the non-impact surfaces of the rotor assembly.

Another problem found in the prior art rotor assemblies shown in FIGS. 1-4 is exposure of a great deal of the surface area of the rotor parts to debris. The plates 3 and 6, the spacers 10, and hammers 11 all receive considerable contact with the debris. This not only creates excessive wear, but contributes to realignment difficulties by bending and damaging the various parts caused by residual impact. Thus, after a period of operation, prior art hammermill hammer assemblies become even more difficult to disassemble and reassemble. The problems related to comminution service and maintenance of hammermills provides abundant incentive for improvement of hammermill hammers to lengthen operational run times.

The hammer 11 embodiments shown in FIGS. 5-22 are mounted upon the hammermill rotating shaft at the hammer rod hole 14. As shown, the effective width of hammer rod hole 14 for mounting of the hammer 11 has been increased in comparison to the hammer neck 20 in FIGS. 5-22. The hammer neck 20 may be reduced in size because forging the steel used to produce the hammer results in a finer grain structure that is much stronger than casting the hammer from steel or rolling it from bar stock as found in the prior art. As disclosed in the prior art a lock collar (not shown) secures the hammer rod 9 in place. Another benefit of the present art is that the amount of material surface supporting attachment of the hammer 11 to the rod 9 is dramatically increased. This has the added benefit of eliminating or reducing the wear or grooving of the hammer rod 9. The design shown in the present art at FIGS. 5-22 increases the surface area available to support the hammer 11 relative to the thickness of the hammer 11. Increasing the surface area available to support the hammer body 11 while improving securement also increases the amount of material available to absorb or distribute operational stresses while still allowing the benefits of the free swinging hammer design i.e. recoil to non-destructible foreign objects.

Figure 7:
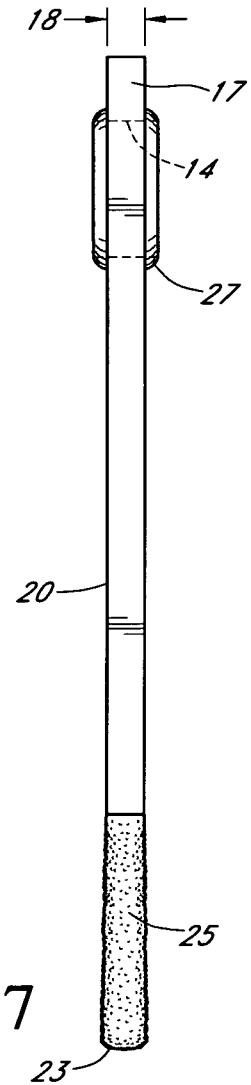
FIG. 7 provides a side view of the first embodiment of the invention.
Figure 5:
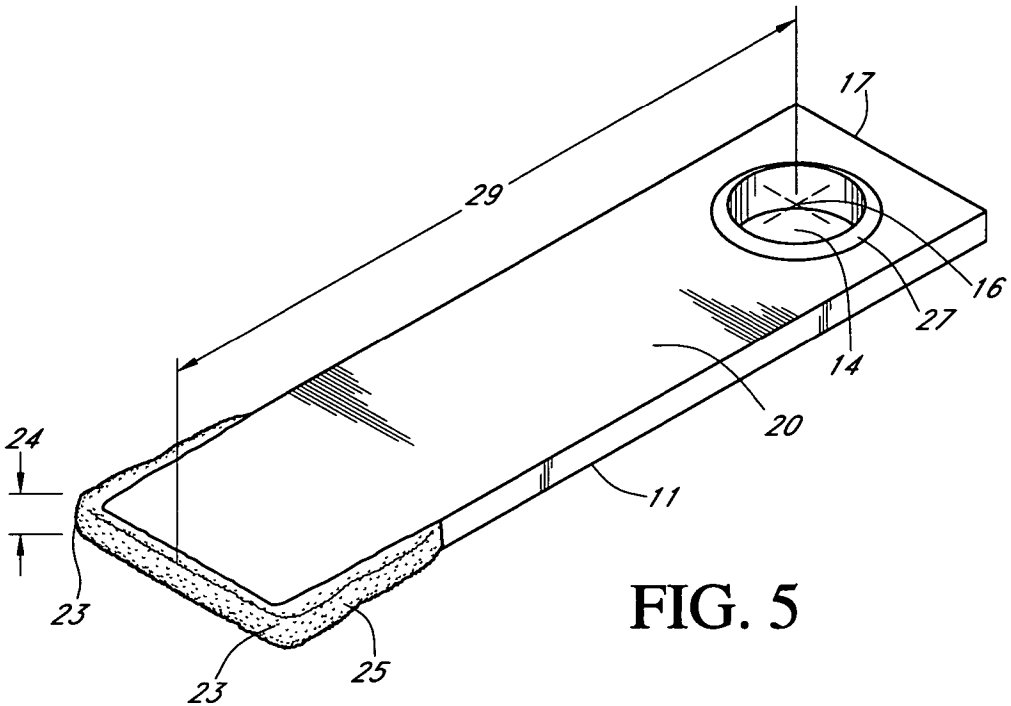
FIG. 5 provides a perspective view of a first embodiment of the invention.
Figure 6:
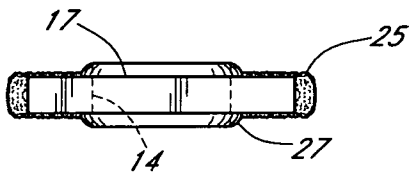
FIG. 6 provides an end view of the first embodiment of the invention.

FIGS. 5-7 show a first embodiment of the present invention, particularly hammers to be installed in the hammermill assembly. FIG. 5 presents a perspective view of this embodiment of the improved hammer 11. As shown, the first end of the hammer 17 is for securement of the invention within the hammermill assembly 1 (not shown) by insertion of the hammer rod 9 through hammer rod hole 14 of the hammer 11. In FIG. 5 the center of the rod hole 16 is highlighted. The distance from the center of rod hole 16 to the contact or second end of the hammer 23 is defined as the hammer swing length 29. Typically, the hammer swing length 29 of the present embodiment is in the range of eight (8) to ten (10) inches with most applications measuring eight and five thirty seconds inches (8 5/32") to nine and five thirty seconds (9 5/32").

In the embodiment of the hammer 11 shown in FIGS. 5-7, the hammer rod hole 14 is surrounded by a single stage hammer rod hole shoulder 27. In this embodiment, the hammer shoulder 27 is composed of a raised single uniform ring surrounding rod hole 14 which thereby increases the metal thickness around the rod hole 14 as compared to the thickness of the first end of the hammer 18. The placement of a single stage hammer shoulder 27 around the hammer rod hole 14 of the present art hammer increases the surface area available for distribution of the opposing forces placed on the hammer rod hole 14 in proportion to the width of the hammer thereby decreasing effects leading to rod hole 14 elongation while the hammer 11 is still allowed to swing freely on the hammer rod 9.

In this embodiment, the edges of the hammer neck 20 connecting the first end of the hammer 17 to the second end of the hammer 23 are parallel or straight. Furthermore, the thickness of the second end of the hammer 24 and the thickness of the first end of the hammer 18 are substantially equivalent. Because the second end of the hammer 23 is in contact with materials to be comminutated, a hardened contact edge 25 is welded on the periphery of the second end of the hammer 23.

FIG. 6 provides an end view of the first embodiment of the invention and further illustrates the thickness of the hammer shoulder 27 in relation the hammer 11 as well as the symmetry of the hammer shoulder 27 in relationship to the thickness of both the first hammer end 17 and second hammer end 23 as shown by hardened welded edge 25. FIG. 7 illustrates the flat, straight forged plate nature of the invention, as shown by the parallel edges of the hammer neck 31 from below the hammer shoulder 27 through the hammer neck 20 to second end 23 which provides an improved design through overall hammer weight reduction as compared to the prior art wherein the hammer neck 20 thickness is equal to the hammer rod hole thickness 14. In the present art, the total thickness of the rod hole 14, including the hammer shoulder 27, may be one and half to two and half times greater than the thickness of the hammer neck 20. In typical applications, the swing length of the present art is in the range of four (4) to eight (8) inches. For example, the forged steel hammer 11 of the first embodiment having a swing length of six (6) inches has a maximum average weight of three (3) pounds. A forged hammer of the prior art with an equivalent swing length having a uniform thickness equal to the thickness of the hammer shoulder 27 would weigh up to four (4) pounds. The present invention therefore improves overall hammermill performance by thirty-three (33%) percent over the prior art through weight reduction without an accompanying reduction in strength. As shown, the hammer requires no new installation procedures or equipment.

Figure 10:
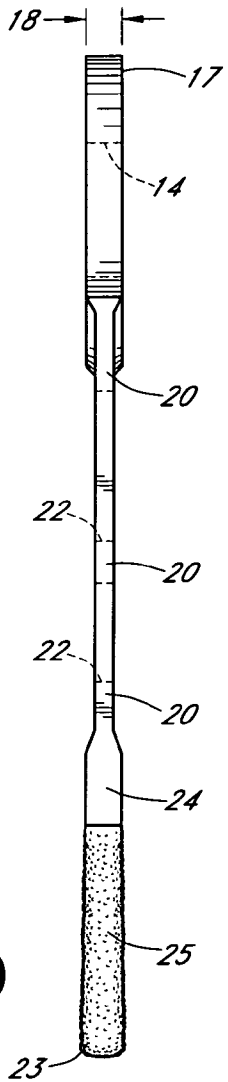
FIG. 10 provides a side view of the second embodiment of the invention.
Figure 8:
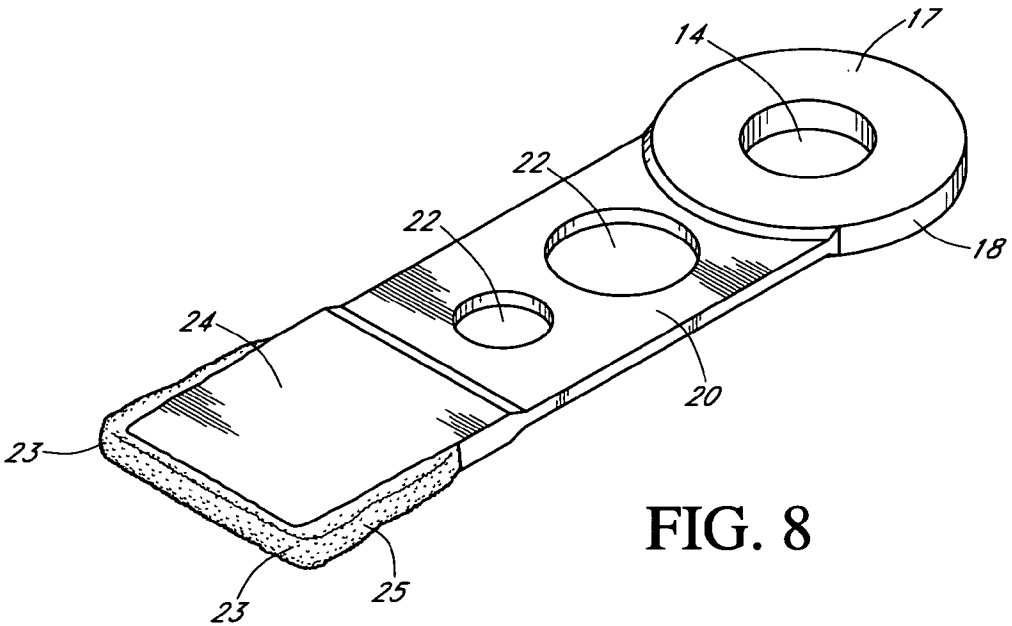
FIG. 8 provides a perspective of second embodiment of the invention.
Figure 9:
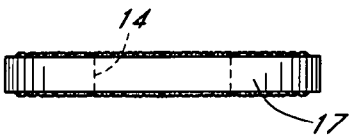
FIG. 9 provides an end view of the second embodiment of the invention.

The next embodiment of hammer 11 is shown in FIGS. 8-10. As shown, the hammer rod hole 14 is again reinforced and strengthened over the prior art. In this embodiment, the rod hole 14 has been strengthened by increasing the thickness of the entire first end of the hammer 18. By comparison, the thickness of hammer neck 20 in this embodiment has been reduced, again effectively reducing the weight of the hammer in comparison to the increased metal thickness around the rod hole 14. This embodiment of the present art hammer also increases the surface area available for distribution of the opposing forces placed on the hammer rod hole 14 in proportion to the thickness of the hammer thereby again decreasing effects leading to rod hole 14 elongation while the hammer 11 is still allowed to swing freely on the hammer rod 9. The thickness of the second end of the hammer 24 and the thickness of the first end of the hammer 18 are substantially equivalent. Because the second end of the hammer 23 is in contact with materials to be comminutated, a hardened contact edge 25 is welded on the periphery of the second end of the hammer 23.

FIG. 8 best illustrates the curved, rounded nature of the second embodiment of the present invention, as shown by the arcuate edges from the first end of the hammer 17 and continuing through hammer neck 20 to the second hammer end 23. To further reduce hammer weight, hammer neck holes 22 have been placed in the hammer neck 20. The hammer neck holes 22 may be asymmetrical as shown or symmetrical to balance the hammer 11. The arcuate, circular or bowed nature of the hammer neck holes 22 as shown allows transmission and dissipation of the stresses produced at the first end of the hammer 17 through and along the neck of the hammer 20.

As emphasized and illustrated by FIGS. 8 and 10, the reduction in hammer neck thickness and weight allowed through both the combination of the hammer neck shape and hammer neck holes 22 provide improved hammer neck strength at reduced weight therein allowing increased thickness at the first and second ends of the hammer, 17 and 23, respectively, to improve both the securement of said hammer 11 and also delivered force at the comminution end of the hammer 23.

Figure 13:
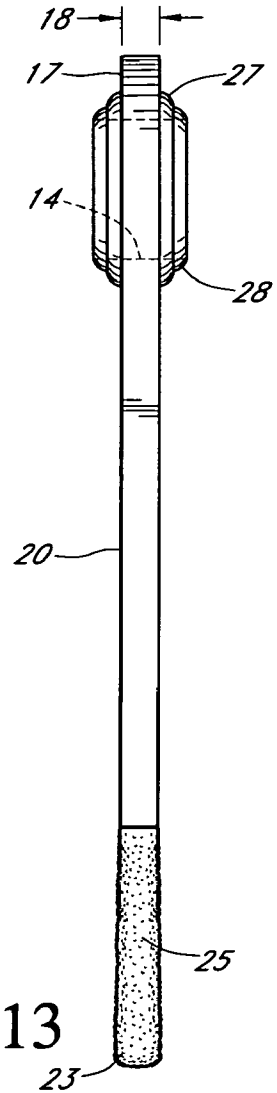
FIG. 13 provides a top view of the third embodiment of the invention.
Figure 11:
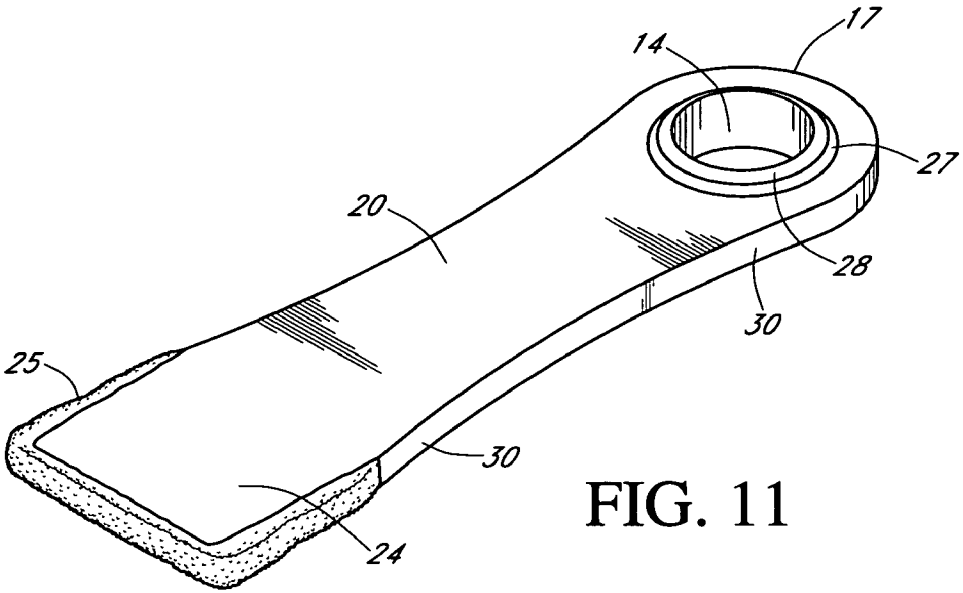
FIG. 11 provides a perspective of third embodiment of the invention.
Figure 12:
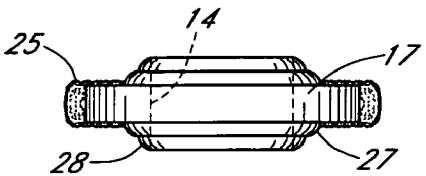
FIG. 12 provides a side view of the third embodiment of the invention.

The next embodiment of hammer 11 is shown in FIGS. 11-13. The perspective view found at FIG. 11 provides another embodiment of the present forged hammer which accomplishes the twin objectives of reduced weight and decreased hammer rod hole elongation. The hammer rod hole 14 is again reinforced and strengthened over the prior art in this embodiment which incorporates hammer rod hole reinforcement via two stages labeled 27 and 28. This design provides increased reinforcement of the hammer rod hole 14 while allowing weight reduction because the rest of the first end of the hammer 18 may be the same thickness as hammer neck 20. This embodiment of the present art hammer also increases the surface area available for distribution of the opposing forces placed on the hammer rod hole 14 in proportion to the width of the hammer thereby again decreasing effects leading to rod hole 14 elongation while the hammer 11 is still allowed to swing freely on the hammer rod 9. As shown by FIG. 13, the thickness of the second end of the hammer 24 and the thickness of the first end of the hammer 17 are substantially equivalent. Because the second end of the hammer 23 is in contact with materials to be comminutated, a hardened contact edge 25 is welded on the periphery of the second end of the hammer 23.

FIG. 11 illustrates the curved hammer neck edges 30 which give the hammer 11 an hourglass shape starting below the hammer rod hole 14 and at the first end of the hammer 17 and continuing through the hammer neck 20 to the second end of the hammer 23. Incorporation of this shape into the third embodiment of the present invention assists with hammer weight reduction while also reducing the vibration of the hammer 11 as it rotates in the hammer mill and absorbs the shock of contact with comminution materials.

As shown and illustrated by FIG. 13 which provides a side view of the present embodiment, the first end of the hammer 17, the neck 20 and the second end of the hammer 23 are of a substantially similar thickness with the exception of the stage 1 and 2 hammer rod hole reinforcement shoulders, 27 and 28, to maintain the hammer's reduced weight over the present art. As emphasized and further illustrated by FIGS. 11-13, the reduction in the hammer profile and weight allowed through both the combination of the hammer neck shape 30 and thickness provide improved hammer neck strength at reduced weight therein allowing placement of the stage 1 and 2 hammer rod hole reinforcement shoulders, 27 and 28, respectively, around the hammer rod hole 14 to improve both the securement of said hammer 11 and performance of the hammermill.

Figure 16:
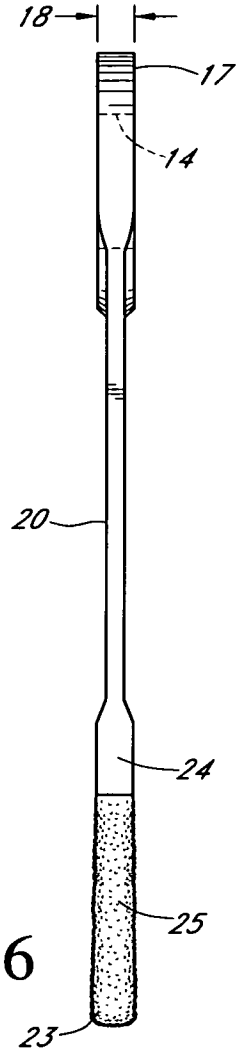
FIG. 16 provides a top view of the fourth embodiment of the invention.
Figure 14:
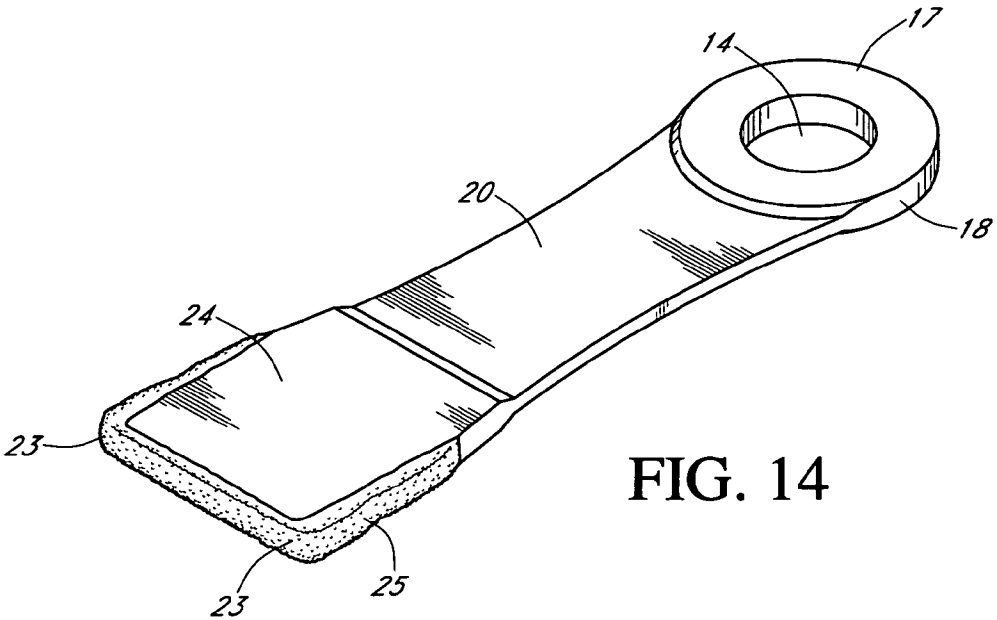
FIG. 14 provides a perspective of fourth embodiment of the invention.
Figure 15:
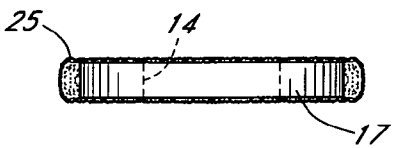
FIG. 15 provides a side view of the fourth embodiment of the invention.

FIGS. 14-16 illustrate a modification of the present invention as shown in previous FIGS. 8-10. In this embodiment the hammer 11 is shown without the hammer neck holes 22 shown in FIGS. 8-10. This embodiment of the present invention, without hammer neck holes 22, provides an improvement over the present art by combining a thickened or thicker hammer rod hole 14 by increasing the thickness of the first or securement end of the hammer 17 in relation to the hammer neck 20 and second end of the hammer 23. This modification of the embodiment is lighter and stronger than the prior art hammers.

Figure 19:
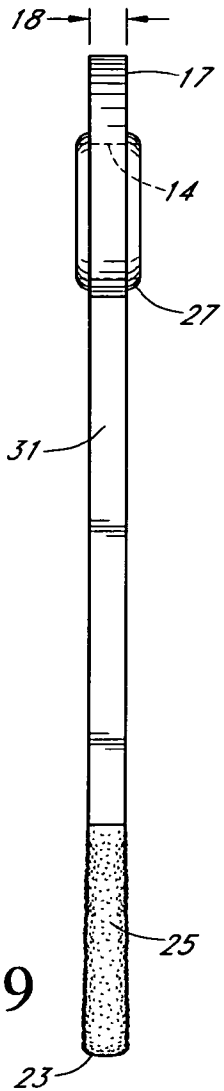
FIG. 19 provides a top view of the fifth embodiment of the invention.
Figure 17:
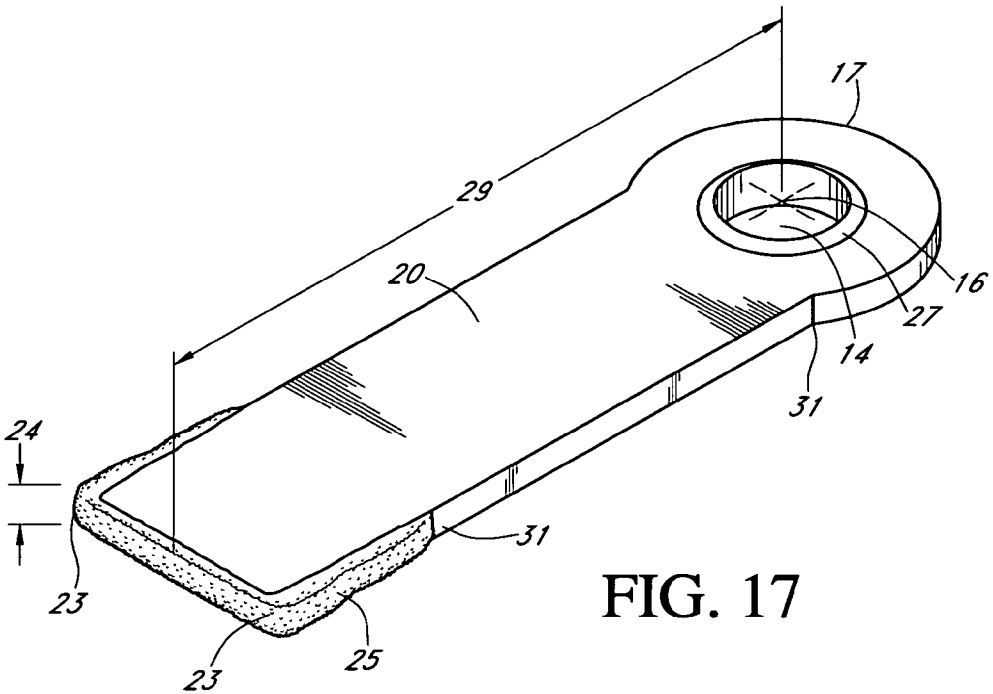
FIG. 17 provides a perspective of fifth embodiment of the invention.
Figure 18:
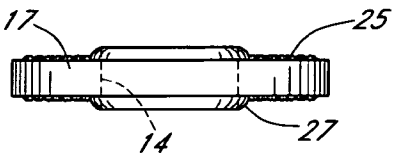
FIG. 18 provides a side view of the fifth embodiment of the invention.

FIGS. 17-19 present another embodiment of the present art wherein the first end of the hammer 17, the hammer neck 20 and the second end of the hammer 23 are substantially of similar thickness i.e. the dimensions represented by 18 and 24 are substantially equivalent. In this embodiment, the hammer rod hole 14 has been strengthened through placement of a single reinforcing hammer shoulder 27 around the perimeter of the hammer rod hole 14, on both sides or faces of the hammer 11. The rounded shape of the first end of the hammer 17 strengthens the first end of the hammer 17 by improving the transmission of any hammer rod 9 vibration away from the securement end of the hammer 17 through the hammer neck 20 to the second end of the hammer 23. The round shape also allows further weight reduction. In this embodiment, the hammer neck edges 31 are parallel as are the hammer neck edges in FIGS. 5-7. A hardened contact edge 25 is shown welded on the periphery of the second end of the hammer 23.

Figure 22:
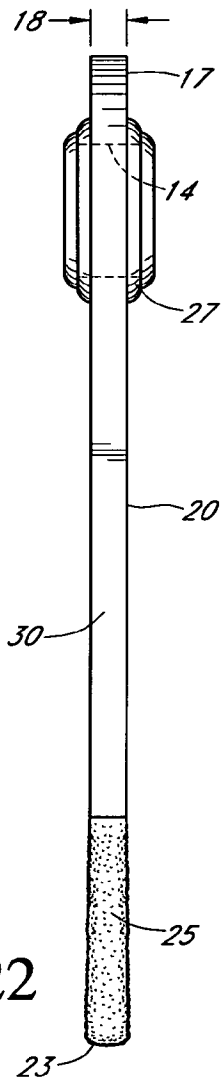
FIG. 22 provides side view of the sixth embodiment of the invention.
Figure 20:
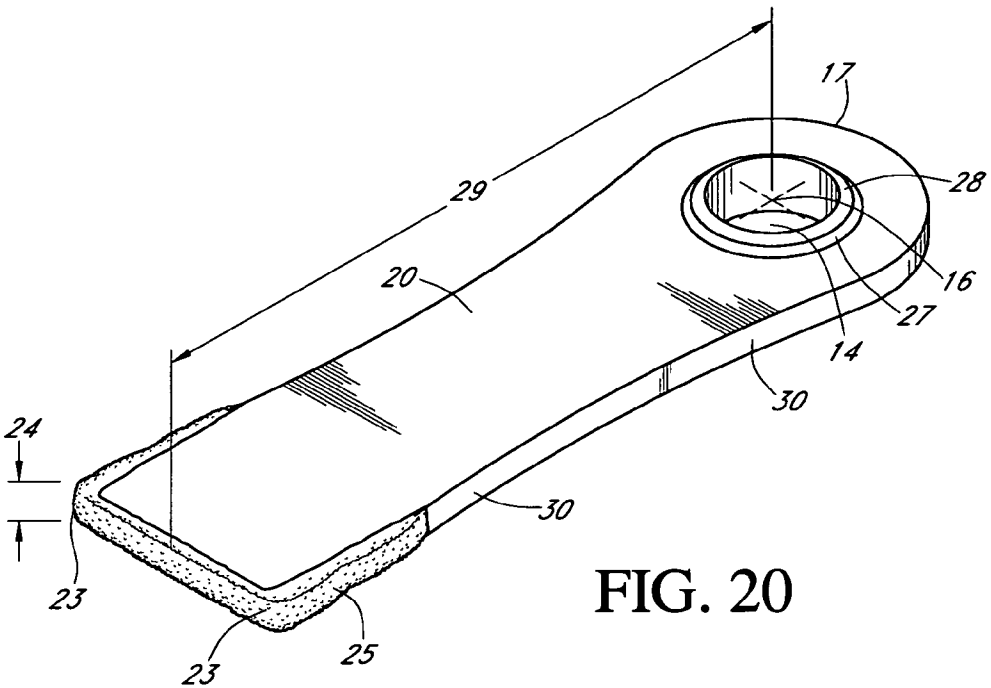
FIG. 20 provides a perspective of the sixth embodiment of the invention.
Figure 21:
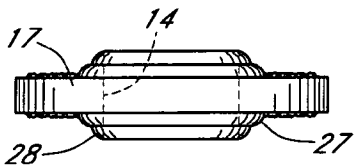
FIG. 21 provides an end view of the sixth embodiment of the invention.
Figure 23:
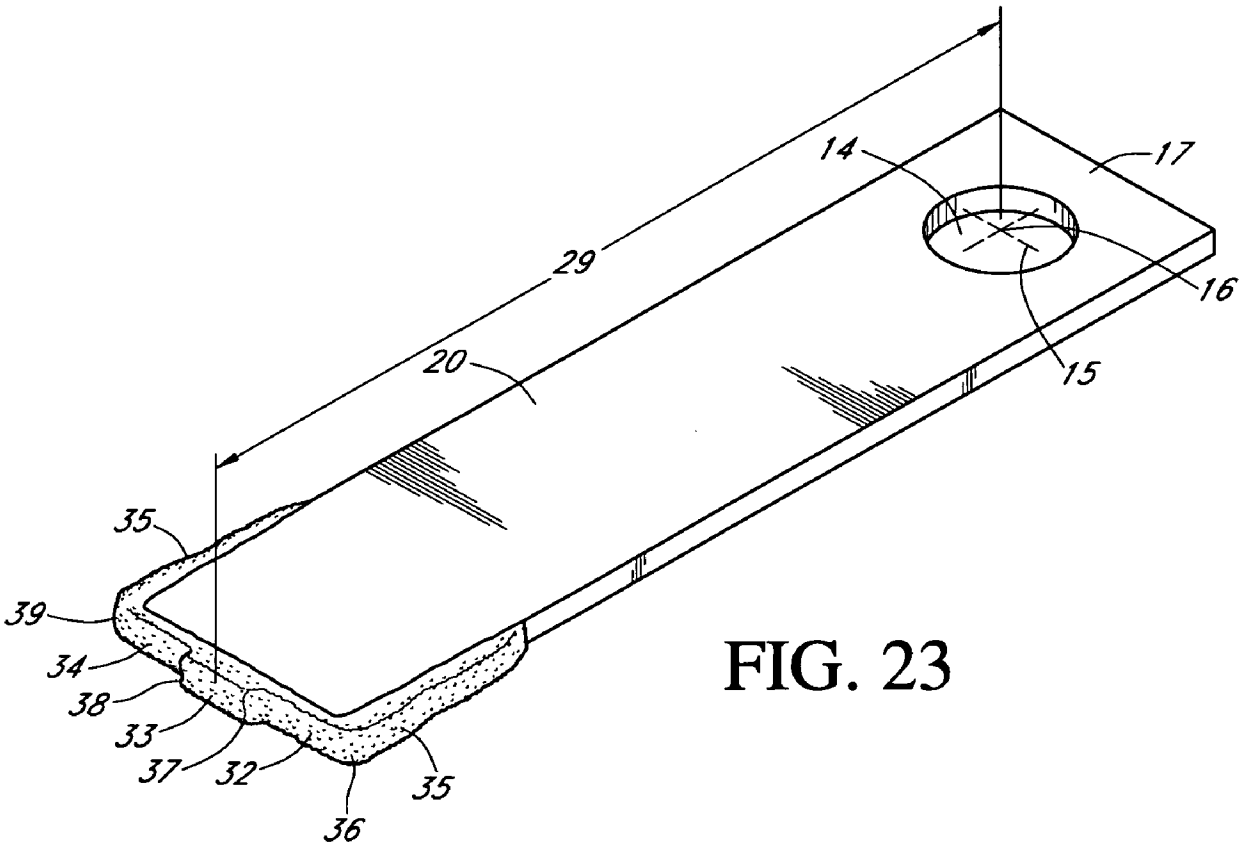
FIG. 23 provides a perspective of the seventh embodiment of the invention.
Figure 24:
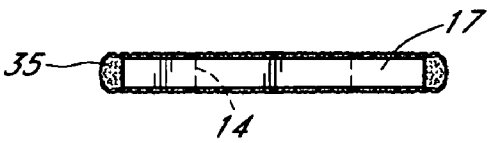
FIG. 24 provides an end view of the seventh embodiment of the invention.
Figure 25:
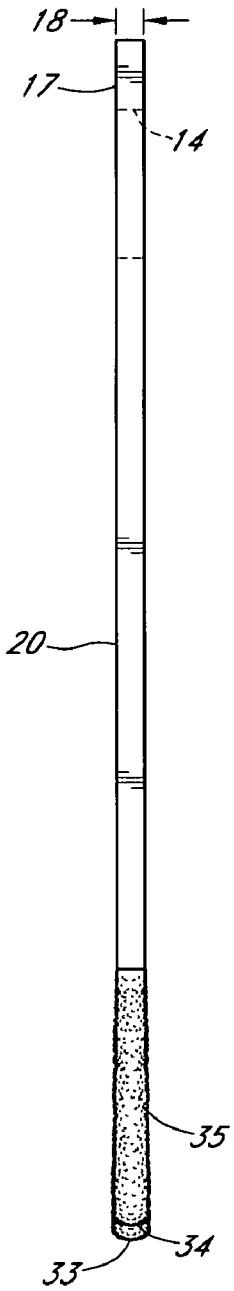
FIG. 25 provides a side view of the seventh embodiment of the invention.

FIGS. 20-22 present another embodiment of the present art wherein the first end of the hammer 17, the hammer neck 20 and the second end of the hammer 23 are substantially of similar thickness i.e. the dimensions represented by 18 and 24 are substantially equivalent. In this embodiment, the hammer rod hole 14 has been strengthened through placement of a single reinforcing stage 27 around the perimeter of the hammer rod hole 14, on both side or faces of the hammer 11. A hardened contact edge 25 is shown welded on the periphery of the second end of the hammer 23. In this particular embodiment, the hammer neck edges 30 have been rounded to further improve vibration energy transfer to the second end of the hammer 23 and away from the securement end of the hammer 17.

FIGS. 23-30 illustrate two additional embodiments of the present art. As shown, the hammers 11 illustrated in FIGS. 23-30 present an increased number of individual contact surfaces to improve available comminution contact surface area. This improvement may be embodied in hammers 11 produced using either casting or forging techniques. Additionally, the body of the hammer 12 may be improved by heat treatment methods known to those practiced in the arts for improved wear characteristics.

Typically, the hammer 11 embodiments shown in FIGS. 23-26 are mounted upon the hammermill rotating shaft at the hammer rod hole 14. As disclosed in the prior art a lock collar (not shown) secures the hammer rod 9 in place. As shown in FIGS. 23-26, the thickness of the neck connecting said the first hammer end to the second hammer end has not been reduced in relation to first and second hammer ends. During typical use of the present embodiment, two of the three contacting surfaces edges are used. As those practiced in the arts will understand, the metallic based hammer as disclosed may be used bi-directionally by either reversing the direction of rotation of the hammermill assembly or in a fixed direction of rotation hammermill assembly, the hammer may be re-installed in the hammermill assembly in a reverse orientation to allow a reversal of the contact surfaces as described further herein.

The second end of the hammer 23 has three distinct contact surfaces (32, 33, 34) respectively. The hammer 11 as shown is symmetrical along the length of the hammer neck 20 so that during normal operation in a first direction of rotation, the edges of the first and second contact surfaces, 32 and 33, respectively, will be the leading surfaces. The third contact surface will be a trailing edge and will wear very little. The first contact point 36 and the second contact point 37 will be the leading contact points. The third contact point 38 and the fourth contact points 39 will be the trailing contact points and will wear very little.

If the direction of rotation of the hammer 11 is reversed, either by reversing the direction of rotation of the hammermill assembly 1 or re-installing the hammer 11 in the opposite orientation, the third contact surface 34 and the second contact surface 33 will be the leading surfaces. The third contact point 38 and the fourth contact point 39 will be the leading contact points. The first contact point 36 and the second contact point 37 will then be in the trailing position.

As shown, the combined width of the contacting surfaces (32, 33 and 34) is substantially equivalent to the width of the second end of the hammer 11. In the embodiments shown, the edges of the hammer 11 have been welded to increase hardness. Tungsten carbide has been applied by welding to the periphery of the second end for increased hardness. Other types of welds as well known to those practiced in the arts may also be applied.

Figure 26:
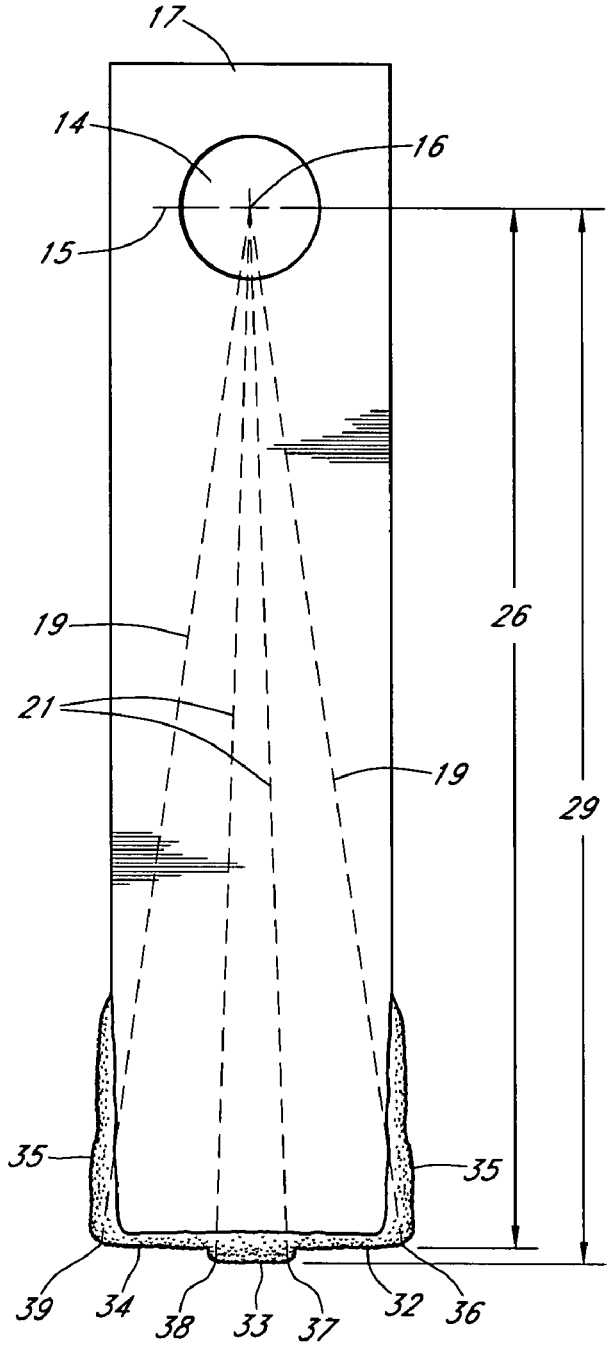
FIG. 26 provides a top view of the seventh embodiment of the invention.
Figure 27:
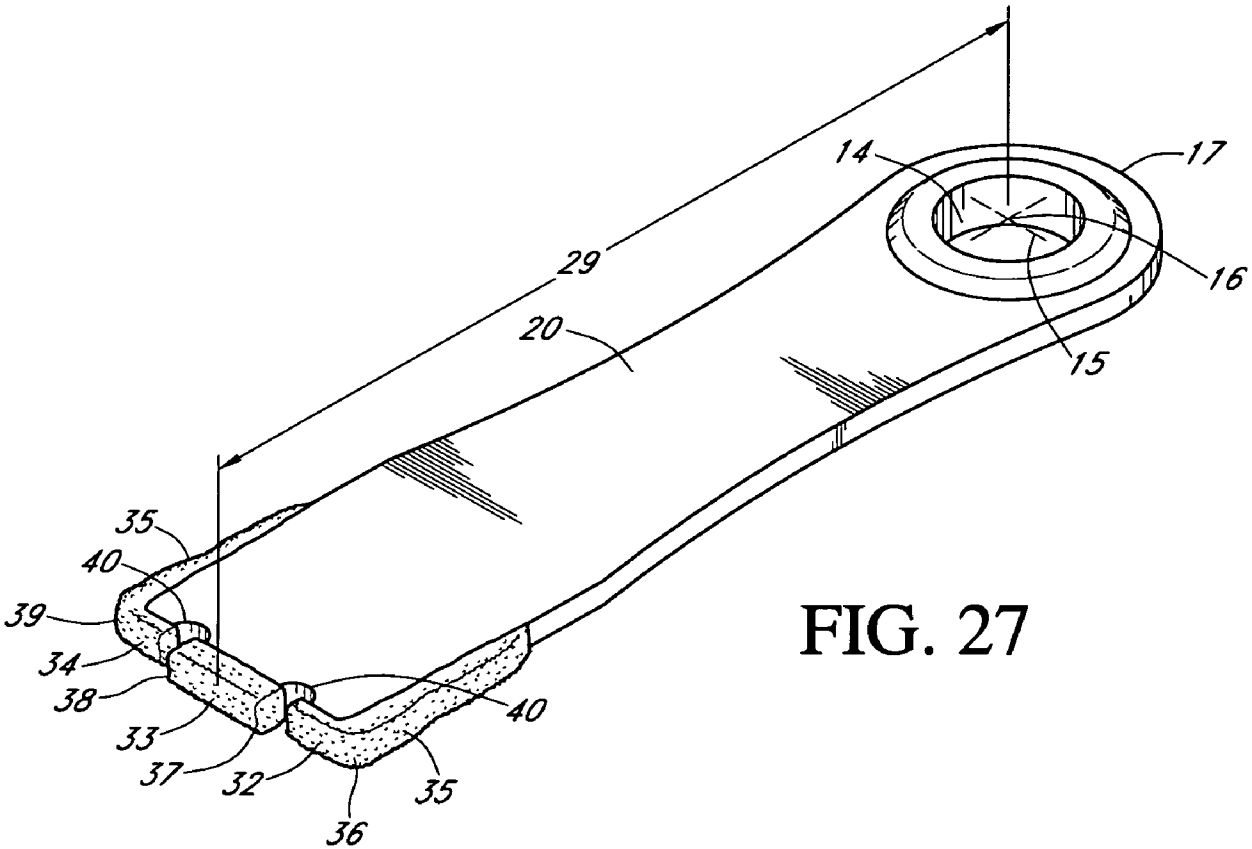
FIG. 27 provides a perspective of the eight embodiment of the invention.
Figure 28:
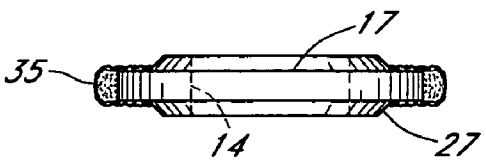
FIG. 28 provides an end view of the eight embodiment of the invention.
Figure 29:
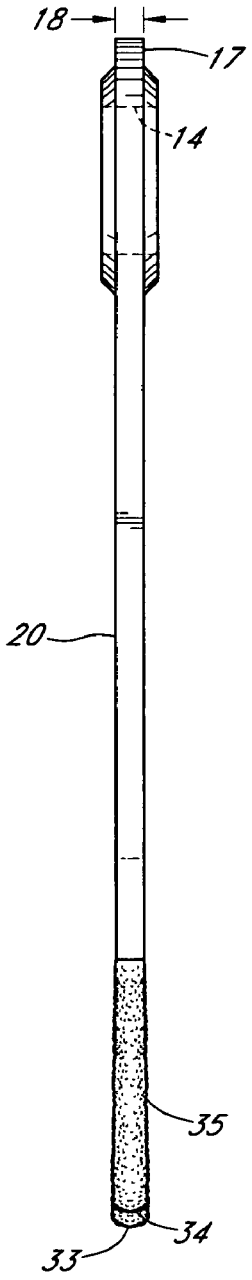
FIG. 29 provides a side view of the eight embodiment of the invention.
Figure 30:
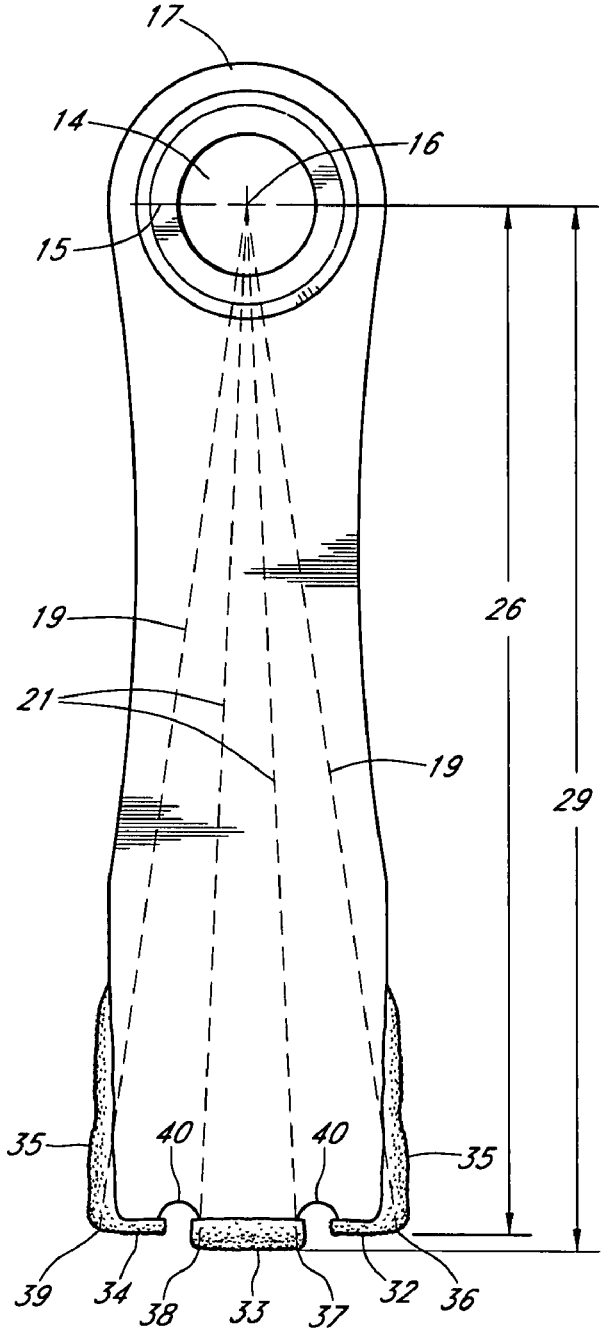
FIG. 30 provides a top view of the eight embodiment of the invention.
Figure 31:
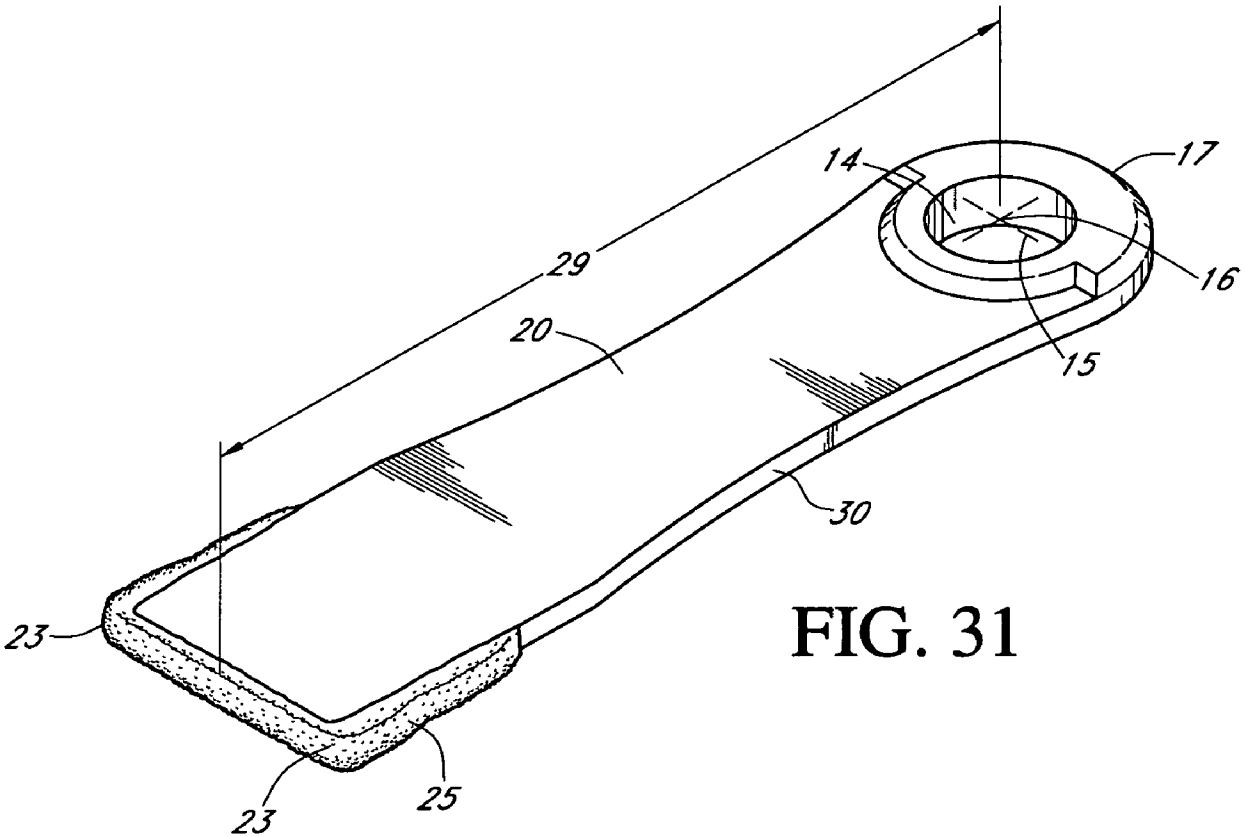
FIG. 31 provides a perspective view of the ninth embodiment of the invention.

As best shown in FIG. 26, the distance to the second contact surface 33 from the rod hole centerline 15 is not equal to the distance from rod hole centerline 15 to the first and third contact surfaces, 32 and 34, respectively. The three contact surfaces (32, 33 and 34) have first 36, second 37, third contact 38 and fourth contact 39 points for contact and delivery of momentum to the material to be comminuted. The radial distance from the center of the rod hole 16 to the first 36, second 37, third 38 and fourth 39 contact points are equal. This spatial relationship is best illustrated in FIG. 26 and FIG. 30. The radial distance from the center of the rod hole 16 to the first and fourth contact points, 36 and 39, respectively, is labeled 19. The radial distance from the center of the rod hole 16 to the second and third contact points, 37 and 38, respectively, are labeled 21.

FIGS. 27-30 illustrate another version of the present art wherein an edge pocket 40 has been placed at the second end of the hammer 23. The edge pocket(s) 40 are notched portion(s) placed fore and aft of the second contact surface 33 to allow temporary insertion or "pocketing" of the comminution materials during rotation of the hammermill assembly 1 to increase loading upon the contacting surfaces and thereby increase hammer contact efficiency and overall hammermill efficiency. The depth of the hammer edge pocket is proportional to the difference between the hammer swing length 29 and the distance from the rod hole center line 15 to the first or third contact surfaces, 32 and 34, respectively. The depth of the hammer edge pocket is in the range of 0.25 to 2 times the thickness of the hammer. The geometry of the edge pocket 39 may be rounded or sloped (not shown).

In the embodiment shown in FIGS. 27-30 the effective width of hammer rod hole 14 for mounting of the hammer 11 has been increased in comparison to the hammer neck 20 in FIGS. 1-4. The hammer neck 20 may be reduced in size because forging the steel used to produce the hammer results in a finer grain structure that is much stronger than casting the hammer from steel or rolling it from bar stock as found in the prior art. As disclosed in the prior art a lock collar (not shown) secures the hammer rod 9 in place. Another benefit of the present art is the amount of material surface supporting attachment of the hammer 11 to the rod 9 is dramatically increased. This has the added benefit of eliminating or reducing the wear or grooving of the hammer rod 9. The design shown in the present art at FIGS. 27-30 increases the surface area available to support the hammer 11 relative to the thickness of the hammer 11. Increasing the surface area available to support the hammer body 11 while improving securement also increases the amount of material available to absorb or distribute operational stresses while still allowing the benefits of the free swinging hammer design i.e. recoil to non-destructible foreign objects.

Figure 32:
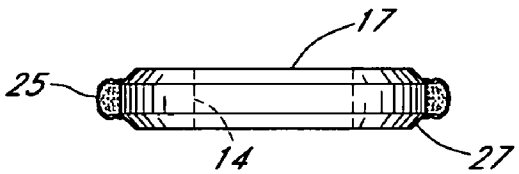
FIG. 32 provides an end view of the ninth embodiment of the invention.
Figure 33:
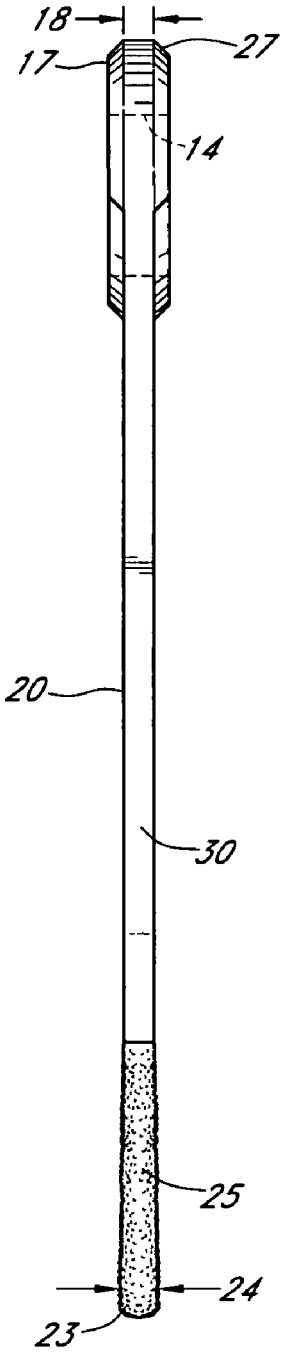
FIG. 33 provides a side view of the ninth embodiment of the invention.
Figure 34:
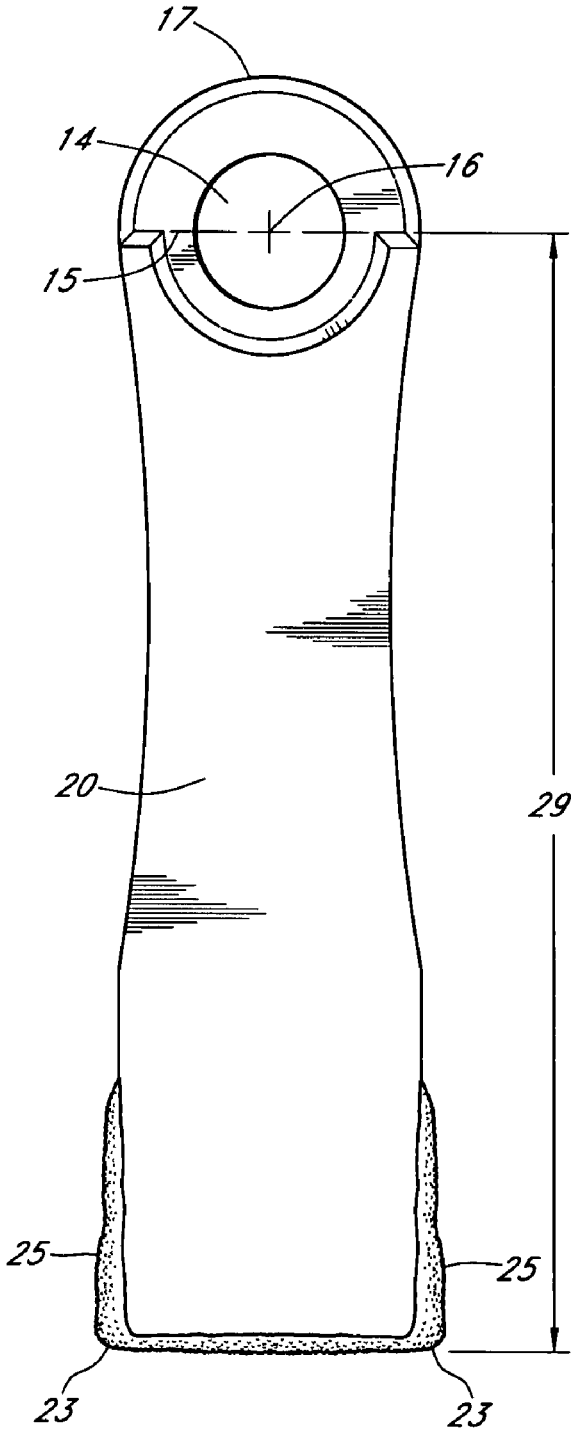
FIG. 34 provides a top view of the ninth embodiment of the invention.
Figure 35:
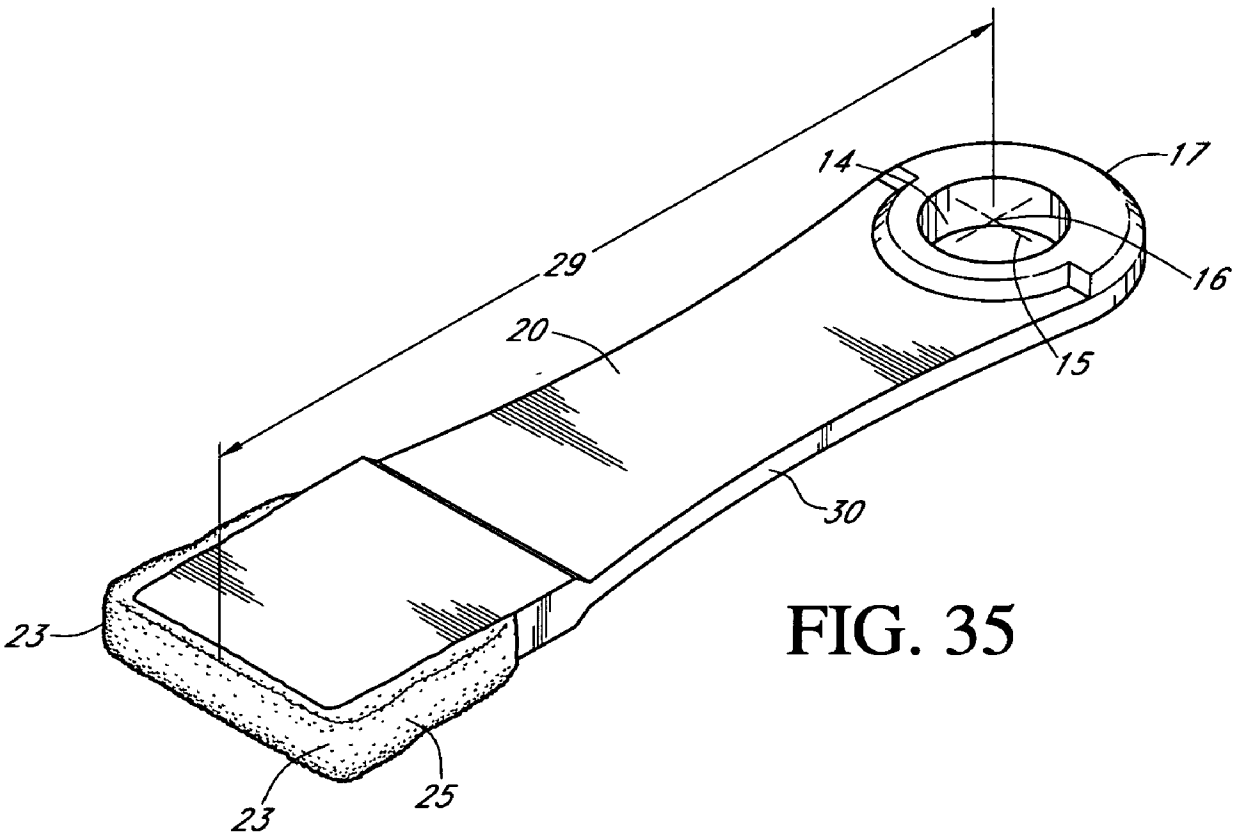
FIG. 35 provides a perspective view of the tenth embodiment of the invention.

FIGS. 31-34 present another embodiment of the present art wherein the first end of the hammer 17, the hammer neck 20, and the second end of the hammer 23 are substantially of similar thickness. That is, as shown in FIG. 33 the thickness of first end of hammer 18, the thickness of the hammer neck 20, and the thickness of second end of hammer 24 are substantially equivalent. In this embodiment, the hammer rod hole 14 has been strengthened through placement of a single stage hammer rod hole shoulder 27 around a portion of the perimeter of the hammer rod hole 14 on both sides or faces of the hammer 11, as shown in FIG. 32. As shown, the shoulder 27 surrounding a portion of the hammer rod hole 14 adjacent the hammer neck 20 is reduced in the radial dimension. The rounded shape of the first end of the hammer 17 strengthens the first end of the hammer 17 by improving the transmission of any hammer rod 9 vibration away from the first end of the hammer 17 (i.e., the end of the hammer 11 that is engaged with the hammer rod 9) through the hammer neck 20 to the second end of the hammer 23. The round shape also allows further weight reduction. In this embodiment, the hammer neck edges 30 are rounded. A hammer hardened contact edge 25 is shown welded on the periphery of the second end of the hammer 23.

Figure 36:
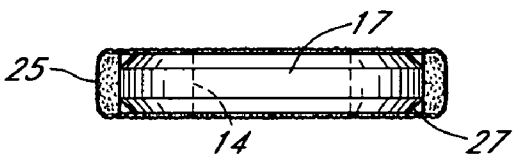
FIG. 36 provides an end view of the tenth embodiment of the invention.
Figure 37:
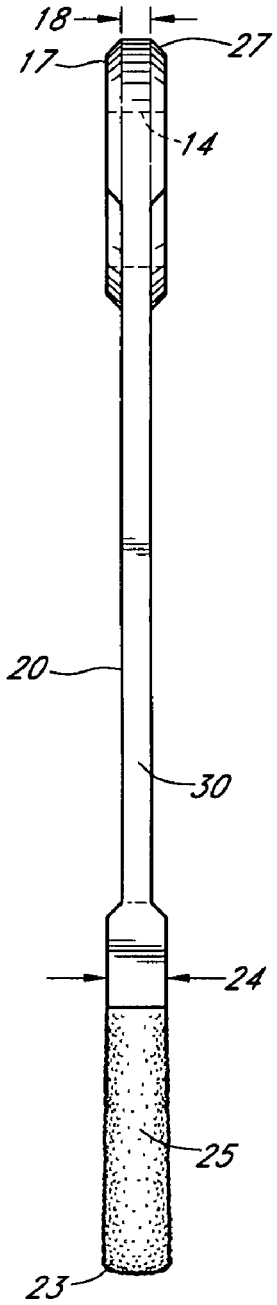
FIG. 37 provides a side view of the tenth embodiment of the invention.
Figure 38:
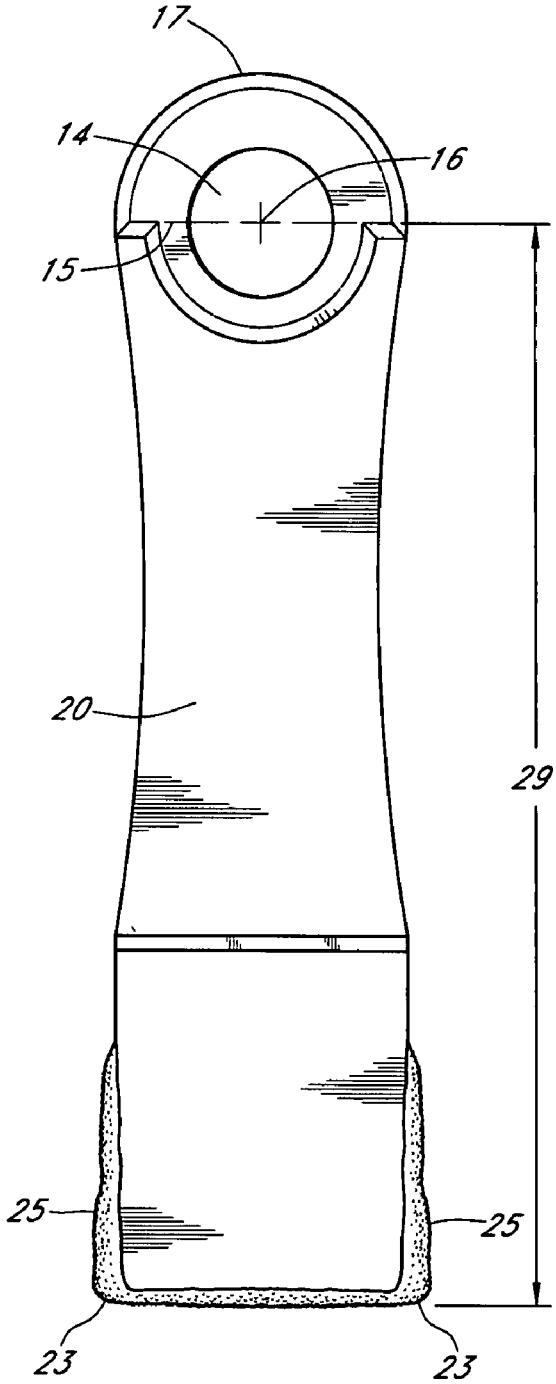
FIG. 38 provides a top view of the tenth embodiment of the invention.

FIGS. 35-38 present another embodiment of the present art wherein the first end of the hammer 17 and the hammer neck 20 are substantially of similar thickness. That is, as shown in FIG. 36, the thickness of the first end of hammer 18 and the thickness of the hammer neck 20 are substantially equivalent. However, the thickness of the second end of hammer 24 is greater than either the thickness of the hammer neck 20 or the thickness of the first end of hammer 18. In this embodiment, the hammer rod hole 14 has been strengthened through placement of a single stage hammer rod hole shoulder 27 around a portion of the perimeter of the hammer rod hole 14 on both sides or faces of the hammer 11, as shown in FIG. 36. A hardened contact edge 25 is shown welded on the periphery of the second end of the hammer 23. In this particular embodiment, the hammer neck edges 30 have been rounded to further improve vibration energy transfer to the second end of the hammer 23 and away from the first end of the hammer 17 (i.e., the end of the hammer 11 that is engaged with the hammer rod 9). As shown, the shoulder 27 surrounding a portion of the hammer rod hole 14 adjacent the hammer neck 20 is reduced in the radial dimension.

Those practiced in the arts will understand that the advantages provided by the hammer design disclosed may be produced by other means not disclosed herein but still falling within the present art taught by applicant.

The invention claimed is:

1. A metallic based hammer for use in a rotatable hammermill assembly comprising:

a. a first end for securement within said hammermill assembly;

b. a rod hole, said rod hole centered in said first end for engagement with and attachment to said hammermill assembly;

c. a second end for contact and delivery of momentum to material to be comminuted;

d. a neck connecting said first hammer end to said second hammer end;

e. a first shoulder adjacent to and surrounding at least a portion of said rod hole, wherein the thickness of said first shoulder is greater than the thickness of said neck, and wherein the thickness of said first shoulder is greater than the thickness of said first end; and f. a second shoulder adjacent to and surrounding at least a portion of said rod hole and adjacent said neck, wherein the thickness of said second shoulder is greater than the thickness of said neck, wherein the thickness of said second shoulder is greater than the thickness of said first end, wherein the distance around the periphery of said first shoulder is greater than that of said second shoulder so that said first shoulder and said second shoulder are non-symmetrical about the longitudinal axis of said rod hole.

2. The metallic based hammer of claim 1 wherein the thickness of said neck is less than the thickness of said second end of said hammer.

3. The metallic based hammer of claim 2 wherein a plurality of shoulders surround and support the portion of said shoulder positioned between said rod hole and said neck.

4. The metallic based hammer of claim 1 wherein hammer swing length is less than ten (10) inches.

5. The metallic based hammer of claim 1 wherein the average weight of the hammer does not exceed three (3) pounds.

6. The metallic based hammer of claim 1 wherein said first end of said hammer is generally round in shape.

7. The metallic based hammer of claim 1, 2, 4, 5, 6, or 3 wherein tungsten carbide has been welded to the periphery of the second end for increased hardness.

8. The metallic based hammer of claim 1 wherein said neck, first end of said hammer, and second end of said hammer are heat-treated for hardness.

9. The metallic based hammer of claim 8 wherein tungsten carbide has been welded to the periphery of the second end for increased hardness.

10. The metallic based hammer of claim 1 wherein said hammer is further defined as comprising at least two distinct contact surfaces on said second end, wherein said at least two distinct contact surfaces are defined by an unequal linear dimension as defined by the linear distance from a rod hole center point in the geometric center of said rod hole to each of said at least two distinct contact surfaces.

11. The metallic based hammer of claim 10 wherein said at least two distinct contact surfaces have a first, a second, a third, and a fourth contact point for contact and delivery of momentum to material to be comminuted.

12. The metallic based hammer of claim 11 wherein the radial distance from said rod hole center point to said first, second, third, or fourth contact points are equal.

13. The metallic based hammer of claim 11 wherein the thickness of said neck is less than the thickness of said first end of said hammer.

14. The metallic based hammer of claim 1 wherein said hammer is forged.

15. The metallic based hammer of claim 14 wherein tungsten carbide has been welded to the periphery of the second end for increased hardness.

16. A metallic based hammer for use in a rotatable hammermill assembly comprising:

a. a first end for securement within said hammermill assembly;

b. a rod hole, said rod hole centered in said first end for engagement with and attachment to said hammermill assembly;

c. a second end for contact and delivery of momentum to material to be comminuted;

d. a neck connecting said first hammer end to said second hammer end;

e. a first shoulder adjacent to and surrounding a first portion of said rod hole, wherein said first shoulder is positioned between said rod hole and said first end of said hammer; and f. a second shoulder adjacent to and surrounding a second portion of said rod hole, wherein said second shoulder is adjacent said neck, wherein the distance along the periphery of said second shoulder is less than that of said first shoulder such that said first shoulder and said second shoulder are non-symmetrical about the longitudinal axis of said rod hole.

* * * * *